US009873027B2

(12) United States Patent
Hamada

(10) Patent No.: US 9,873,027 B2
(45) **Date of Patent: *Jan. 23, 2018**

(54) PUTTER ALIGNMENT GUIDE BAR

(71) Applicant: Sadao Hamada, Nankoku (JP)

(72) Inventor: Sadao Hamada, Nankoku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/726,163

(22) Filed: May 29, 2015

(65) Prior Publication Data

US 2015/0343275 A1 Dec. 3, 2015

Related U.S. Application Data

(63) Continuation-in-part of application No. 14/293,253, filed on Jun. 2, 2014.

(51) Int. Cl.

| | |
|---|---|
| ***A63B 69/36*** | (2006.01) |
| ***A63B 53/04*** | (2015.01) |
| ***A63B 53/00*** | (2015.01) |
| *A63B 37/00* | (2006.01) |

(52) U.S. Cl.

CPC ..... *A63B 53/007* (2013.01); *A63B 53/0487* (2013.01); *A63B 69/3685* (2013.01); *A63B 37/0022* (2013.01); *A63B 2053/0441* (2013.01); *A63B 2069/3682* (2013.01)

(58) Field of Classification Search

CPC ..... A63B 53/007; A63B 69/3685; A63B 2069/3682; A63B 2053/0441; A63B 53/0487; A63B 37/0022

USPC ..... 473/340, 341, 251–254, 231, 238, 242, 473/313

See application file for complete search history.

(56) References Cited

U.S. PATENT DOCUMENTS

| | | | | |
|---|---|---|---|---|
| 837,030 A | | 11/1906 | Blanchard | |
| 2,670,209 A | * | 2/1954 | Fay | A63B 69/3685 33/286 |
| 3,198,525 A | | 8/1965 | Smith | |
| 3,292,928 A | | 12/1966 | Billen | |
| 3,298,693 A | * | 1/1967 | Eisenberg | A63B 69/3632 473/238 |
| 3,448,981 A | * | 6/1969 | Anweiler | A63B 53/007 473/314 |

(Continued)

FOREIGN PATENT DOCUMENTS

| | | | |
|---|---|---|---|
| WO | WO0117621 | A1 | 3/2001 |
| WO | WO2007094679 | A1 | 8/2007 |

*Primary Examiner* — Sebastiano Passaniti

(74) *Attorney, Agent, or Firm* — Schaffer IP Law, LLC

(57) ABSTRACT

A putting alignment apparatus comprises a vertical portion and a horizontal portion that may exist separately as an alignment device, or integrated within the putter itself. The vertical portion of the alignment apparatus is configured to be attached to the club head and sized to extend vertically above the height of a golf ball. The horizontal portion is coupled to an upper end of the vertical portion and sized to extend forwardly of the striking face when the putting alignment apparatus is attached to the club head. An alignment structure or aperture such as a linear edge or slot is formed in the horizontal portion forwardly of the striking face, wherein a mark placed on the golf ball may be aligned with the structure or within the aperture to facilitate alignment of the golf club with the golf ball in a direction of intended movement. A golf club including such an alignment structure has the shaft coupled directly to the alignment device.

16 Claims, 6 Drawing Sheets

(56) References Cited

U.S. PATENT DOCUMENTS 3,698,093 A 10/1972 Marshall
4,002,343 A * 1/1977 Eckert ..... A63B 69/3685 473/251
4,209,172 A * 6/1980 Yamamoto ..... A63B 69/3685 473/200
4,227,694 A * 10/1980 Drake ..... A63B 53/007 473/255
4,520,887 A * 6/1985 DiFazio ..... B60R 16/04 180/68.5
4,647,045 A * 3/1987 Bilyeu ..... A63B 69/3685 473/238
4,953,867 A * 9/1990 Rigsby ..... A63B 69/3685 473/238
4,988,107 A * 1/1991 Sasse ..... A63B 69/3685 473/254
5,267,733 A * 12/1993 Szokola ..... A63B 53/007 473/313
5,382,019 A * 1/1995 Sneed ..... A63B 53/02 473/304
5,425,520 A * 6/1995 Masumoto ..... A47B 96/06 248/188
5,476,262 A * 12/1995 Bandiero ..... A63B 53/0487 473/234
5,494,288 A * 2/1996 Jimenez ..... A63B 53/0487 473/313
5,538,249 A 7/1996 Benson
6,039,657 A * 3/2000 Gidney ..... A63B 53/0487 473/252
6,422,949 B1 * 7/2002 Byrne ..... A63B 69/3688 473/200
7,033,283 B2 * 4/2006 Kang ..... A63B 69/3685 473/231
7,341,526 B2 3/2008 McCarthy
7,803,066 B2 9/2010 Solheim et al.
7,815,515 B1 10/2010 Hunt
7,905,793 B2 3/2011 O'Neill
7,927,226 B1 4/2011 Twitty
8,075,416 B2 12/2011 Stites et al.
8,128,505 B2 3/2012 Tryner et al.
8,308,583 B2 11/2012 Morris et al.
8,506,415 B2 * 8/2013 Franklin ..... A63B 53/0487 473/251
8,616,992 B2 12/2013 Kim
2005/0187028 A1 8/2005 Chang et al.
2010/0190573 A1 7/2010 Boyd

* cited by examiner

PUTTER ALIGNMENT GUIDE BAR

1. CROSS-REFERENCES TO RELATED APPLICATIONS

This application is a continuation-in-part that claims the benefit from U.S. patent application Ser. No. 14/293,253 filed Jun. 2, 2014, whose contents are incorporated herein for all purposes.

BACKGROUND OF THE INVENTION

2. Field of the Invention

This invention relates generally to golf putting aids and more particularly to simple and effective devices for increasing the accuracy of a golfer during the putting operation.

3. Description of the Prior Art

Putting is a very important part of the game of golf. Accurate putters are able to "read" the greens to determine conditions that will affect the roll of the golf ball toward the golf hole. Important conditions that affect the roll of the golf ball include the slope and topography of the path to the golf hole, the grass used on the putting surface, the condition of the grass (e.g. any bare spots), whether and in what direction the blades of grass are laying down, and whether and to what extent the grass is wet thus slowing down the roll of the golf ball. Other important aspects of putting include the distance to the hole and an estimate of how hard to strike the ball, and in what direction, given the conditions of the putt. For this later task, a golfer must correctly read the green to determine speed, topography, grain of the grass, moisture, etc. and determine where to aim, e.g. the initial direction where to start the ball rolling, not necessarily the golf hole but possibly left or right of the hole. The golfer must then align the putter so that the putter face is square to the initial putting direction. Finally, the golfer must execute the correct putting stroke whereby the putter travels parallel to the intended target (e.g. not coming from the outside or inside), the putter travels at the correct speed at impact, and the putter face is square at impact. The current invention assists with proper club alignment to accomplish this later task.

Given the low friction between the golf ball and the putter striking face, a struck golf ball generally travels perpendicular to the plane of the striking face of the club. It is therefore very important to line up the putter head with the golf ball with great precision so that the struck golf ball travels in the desired direction at the desired speed. Various methods have been developed to assist the golfer in lining up his putter with the golf ball including placing alignment marks on the top of the putter head directly behind the golf ball and marks or images in a structure behind the striking part of the club head. Not only are these methods getting more complicated, but are nearly impossible to retrofit onto an existing putter.

A need exists, therefore, for alternate means and structures that allow a golfer to align the club with marks placed on the golf ball itself where such means and structures may be retrofitted on to existing clubs.

SUMMARY OF THE INVENTION

A putting alignment apparatus is used with a golf club of a type having a club head with a striking face formed at a substantially vertical angle. The alignment apparatus comprises a vertical portion and a horizontal portion and may exist separately as an alignment device, or integrated within the putter itself. The vertical portion of the alignment apparatus is configured to be attached to the club head and sized to extend vertically above the height of a golf ball. The horizontal portion is coupled to an upper end of the vertical portion and sized to extend forwardly of and substantially perpendicular to a plane of the striking face when the putting alignment apparatus is attached to the club head. An alignment means, such as one or more aligned apertures, a slot or an aligning edge, is formed in the horizontal portion so that it extends forwardly of the striking face, wherein a mark placed on the golf ball may be aligned with or within the aperture to facilitate alignment of the golf club with the golf ball in a direction of intended movement.

The putting alignment apparatus may include a structure that extends up and over a golf ball and includes alignment means structured to align with a mark made on the golf ball, wherein the alignment means is coupled to the head of the putter at a pivot axis parallel with a sole of the putter and/or the plane of the putting surface.

The golf club of a type further including a shaft coupled to the alignment structure, either adjacent a distal edge forwardly of the golf ball or a proximal edge approximately aligned with the striking face of the club.

When integrated within a golf club, the invention comprises a putter head having a forwardly directed striking face, an opposing putter back wall, and a bottom sole and further including an elongate shaft. The integrated putter alignment apparatus in the club includes a vertical member attached to the putter back wall and extending upward a sufficient distance above the bottom sole of the putter to be higher than a golf ball to be struck by the putter. A horizontal member is attached to the vertical member at an upper end and extending forwardly of the striking face, the elongate shaft coupling to the horizontal member. An alignment structure, such as a linear edge formed along the horizontal member, is aligned with a mark placed on the golf ball to be struck by the putter. Alignment of the mark with the structure from a point of view of a user of the putter facilitates alignment of the putter head with the golf ball so that the struck golf ball travels in an intended direction.

The foregoing and other objects, features and advantages of the invention will become more readily apparent from the following detailed description of a preferred embodiment of the invention that proceeds with reference to the accompanying drawings.

DETAILED DESCRIPTION

Figure 1:
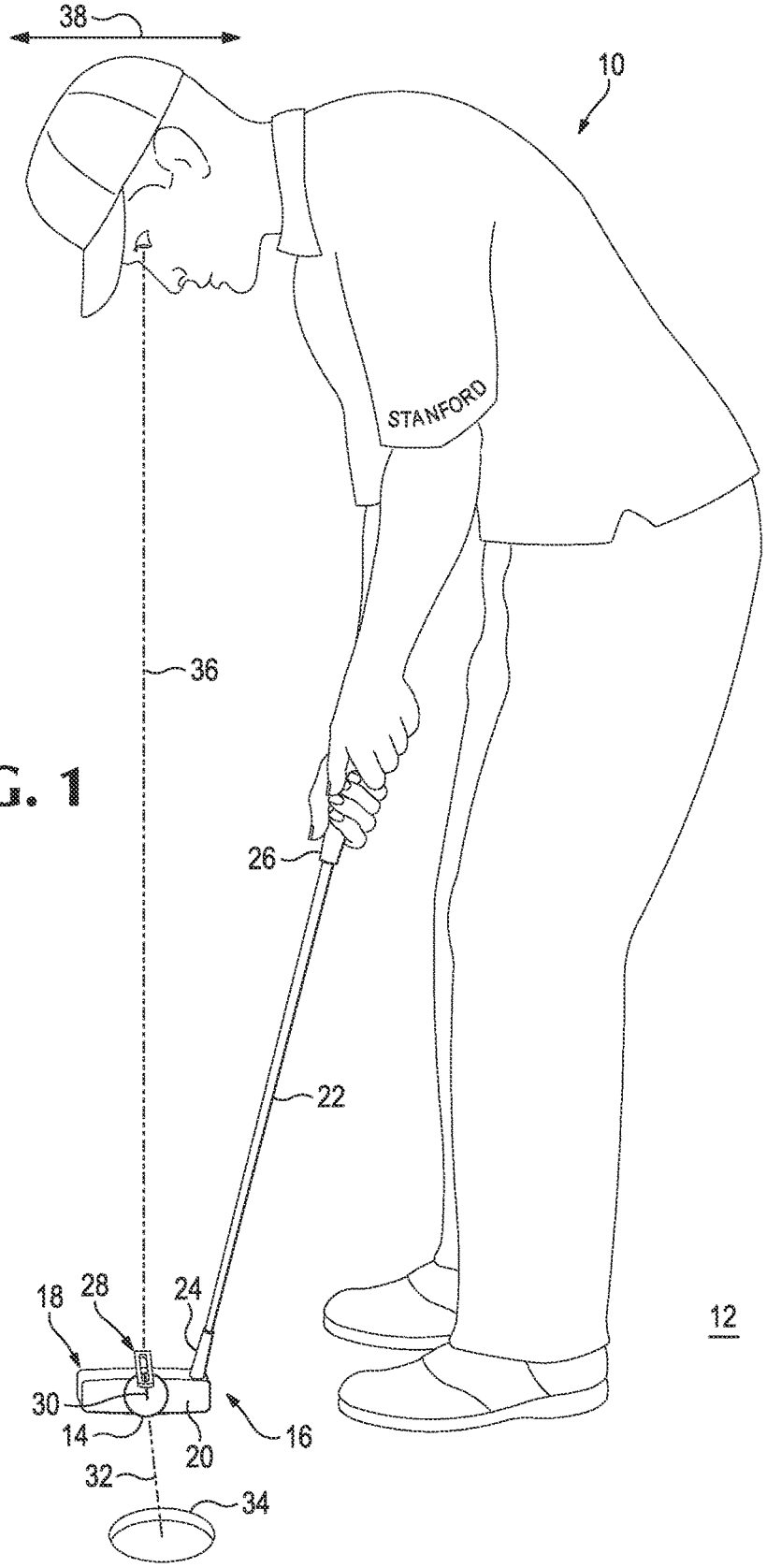
FIG. 1 is a perspective view of a golfer using the putter configured with an alignment guide bar according to a preferred embodiment of the invention.

FIG. 1 illustrates a golfer 10 standing on a putting surface 12 and addressing golf ball 14 with putter 16 in a putting stance. Putter 16 includes a club head 18 with a forward striking face 20 immediately adjacent to golf ball 14. Other parts of the putter include an elongate shaft 22, a hosel 24 coupling the club head 18 with the shaft 22, and a grip 26 grasped by the golfer 10 to swing the putter in an arc and strike the ball 14 with the striking surface 20 to propel the ball along a desired direction of travel 32. The hosel 24 is generally designed to incline the club head 18 from the shaft 22 at a predetermined angle so that a bottom surface/sole of the club head is generally parallel with the putting surface 12.

Putter 16 is fitted with an alignment bar 28 as constructed according to teachings of the invention and described further below. In generally use, the alignment bar 28 is coupled to the golf club head 18 so that it extends up and over the golf ball 14 and is aligned with an elongate mark 30 placed on the golf ball 14. The golf ball 14 is first placed on the putting surface 12 so that mark 30 is aligned with the intended direction of the travel 32 toward the golf cup or hole 34. The alignment bar 28 is then adjusted by methods and means that are described further below so that a site line 36 of the golfer 10 aligns a structure on the alignment bar with the mark 30 on the golf ball when the golfer is in his or her putting stance and addresses the golf ball. With the putter properly aligned with respect to the golf ball, the golf ball may be struck so that the ball moves in the intended putting direction 32. Whereas the intended putting directly is shown in FIG. 1 as directly toward the golf cup 34, it is understood that slope, grain, wind, and other factors may cause the golfer to aim to the side of the hole to anticipate any curving movement the ball may have on the way to cup.

When the putter is correctly aligned and the ball correctly struck, the ball will start rolling toward the intended target with the desired speed and desired rotation. The ball should be only imparted an over spin, absent of any side spin. When the ball mark 30 is struck perpendicular to the mark—e.g. so that the alignment means is perpendicular to the striking face and lined up with the ball mark—then the ball rolls the mark line 30 end over end. A properly aligned and struck ball will result in the golfer only seeing the mark trace a single straight line as the ball rolls. If the line wobbles or the golfer cannot see the line, then this is an indication that the ball may have been struck incorrectly in which case corrective measures can be made before the next putt. But a well struck ball never changes its course as long as the putting surface is flat and has no effects from other variables such as grain of the grass or wind.

Figure 7:
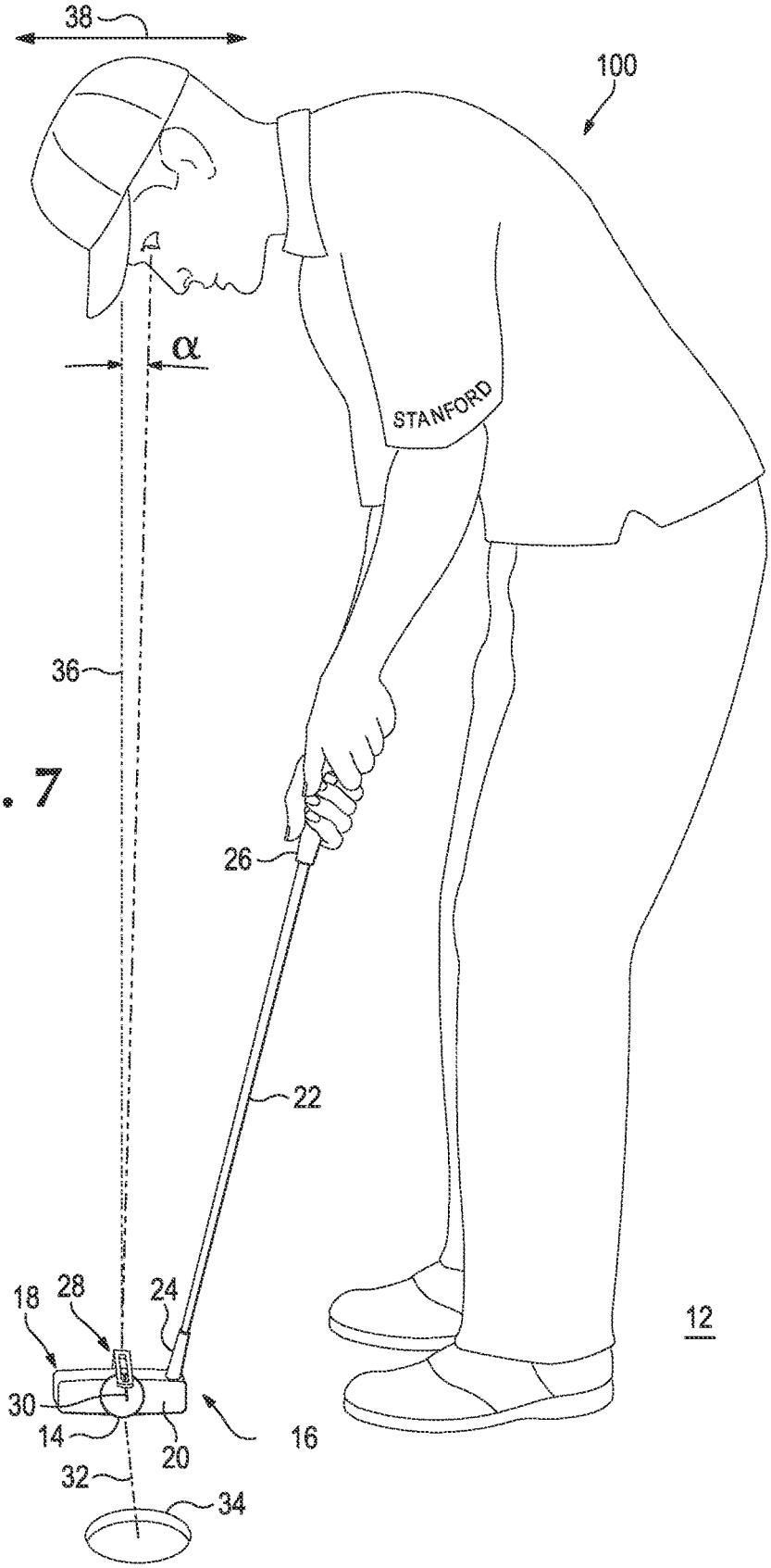
FIG. 7 is a perspective view of a golfer using the alignment guide bar of FIG. 1 but set up to accommodate where the golfer's eyes are closer to his body.

It is further understood that different golfers have different stances and methods for addressing the ball, and that while many position their heads so that their eyes are directly above the golf ball as shown in FIG. 1, other golfers stand so that their eyes are left or right 38 of the golf ball 14 and further from or closer to the golfer's feet. FIG. 7 illustrates the situation where a different golfer 100 sets up so that his eyes are not directly over the golf ball, but rather are inclined at an angle $\alpha$ from vertical so that his eyes are closer to the golfer's body. Because some golfers are not perfectly vertically aligned with the golf ball, it then becomes important to include adjustment means that allow the alignment bar 28 to move and/or tilt in the direction of alignment so that the eyes of the golfer, the alignment means, and the mark 30 on the golf ball 14 may all be properly aligned. In this instance, the alignment bar can be rotated along pin axis 62 to angle $\alpha$ from vertical so that it accommodates the golfer's stance and allows the ball mark 30 to be viewed through window 44.

Figure 2:
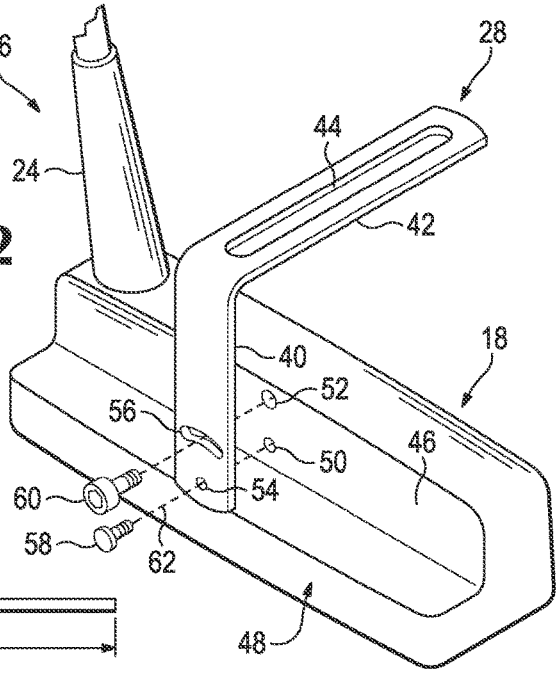
FIG. 2 is an exploded perspective view of the putter head and alignment bar of FIG. 1.
Figure 3:
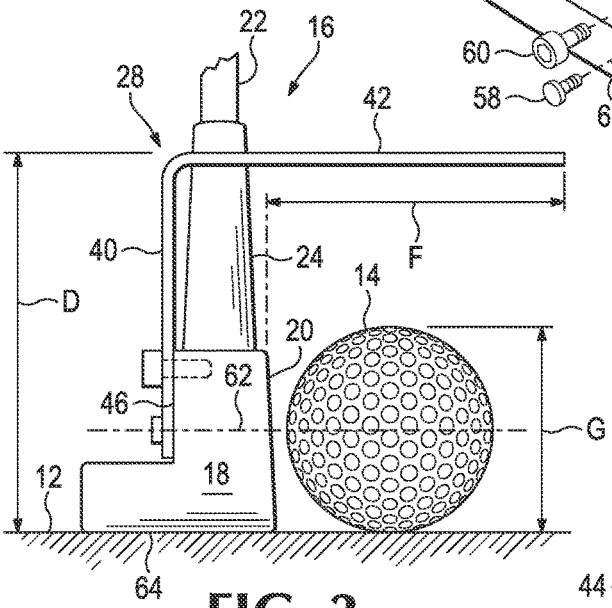
FIG. 3 is a side elevation view of the putter head and alignment bar next to a golf ball.
Figure 4:
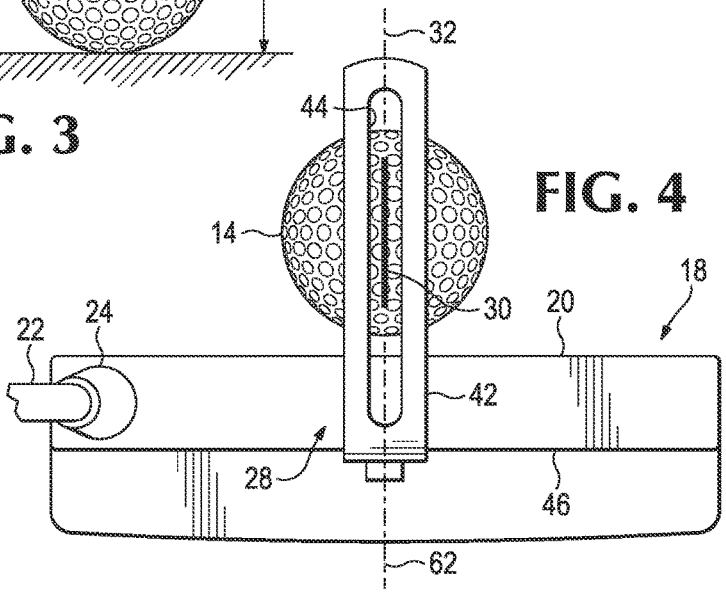
FIG. 4 is a top plan view of the putter head and alignment bar with the line mark on the golf ball centered within the alignment slot of the alignment bar.

FIG. 2 shows the putting alignment apparatus 28 detached from club head 18 in an exploded perspective view. The putting alignment apparatus 28 includes a vertical portion 40 that is configured to be attached to the club head 18 and sized to extend vertically above the putting surface a distance D, which is greater than a height G of a golf ball 14 (see, e.g., FIG. 3). Alignment apparatus 28 further includes a horizontal portion 42 coupled to an upper end of the vertical portion 40 and sized to extend forwardly F of the striking face 20 when the putting alignment apparatus 28 is attached to the club head 18 as shown in FIG. 3. In the embodiment shown, the vertical 40 and horizontal 42 portions are integrated together from a single metal bar bent at ninety degrees. In a preferred embodiment, the horizontal portion 42 is sized to extend forwardly of the golf ball when addressed as shown in FIGS. 3 and 4.

Alignment means or structure of the apparatus 28 can include an aperture, such as elongate slot 44, formed in the horizontal portion 42 forwardly of the striking face 20. As shown in FIG. 4, a mark 30 placed on the golf ball 14 may thus be aligned within the elongate slot 44 to facilitate alignment of the golf club 16 with the golf ball in a direction of intended travel 32. In a preferred embodiment, the elongate slot 44 is centrally formed along a long axis of the horizontal portion 42 of the putting alignment apparatus 28 and sized to capture at least the length of the golf ball.

Although such an alignment apparatus 28 can be integrated into a constructed putter (or other type of golf club), the apparatus can also be retrofitted onto an existing putter and preferably one with a generally vertical back wall 46. By way of example, and in no way intended to limit the applicability of the invention, the putter in FIG. 2 includes a weighted lower lip 48 to lower the center of gravity of the putter head 18. One understands, however, that other putter head shapes are contemplated and that the alignment apparatus and method can be used on most or all of these types.

The vertical member 40 of the alignment apparatus is coupled to the back wall 46 of putter 16. In a preferred embodiment, two threaded holes or apertures 50, 52 are formed horizontally into the back wall 46 of the putter. Lower aperture 50 is in vertically alignment with upper aperture 52. The vertical member 40 includes a first aperture 54 formed through a terminal end of the vertical portion, and a second aperture 56 spaced from the first aperture 54 in a vertical direction an identical distance as between the apertures 50, 52 in the putter back wall 46. The second aperture 56 includes an arcuate slot for limiting a pivot angle of the putting alignment apparatus as explained further below.

The vertical member 40 of alignment apparatus 28 is coupled to the putter head 18 via two pins or screws, such as screws 58, 60. A lower terminal end of the vertical member 40 is affixed to the putter head 18 via screw 58. Screw 58 is arranged to pass through apertures 50, 54 to form a pivot axis 62 that is parallel to the putting surface 12 (which itself is intended to be parallel to the sole 64 of the putter) and located along the rear vertical wall 46 of the putter head 18 to be approximately at or above the ball center height P (where P is approximately equal to ½G).

A second portion of the alignment apparatus 28 is affixed to the vertical wall 46 of the putter head 18 via second screw 60. Second screw 60 passes through the arcuate slot 56 formed in the vertical member 40 of the alignment apparatus 28 and threads into the upper aperture 52 formed in the putter head 18 vertical wall 46. In use, the second screw 60 is loosened so that the alignment apparatus 28 can be pivoted about pivot axis 62. Once the site line 36 is properly angled so that the golf ball mark 30 is properly aligned within the alignment slot 44 as viewed from the golfer's point of view, the second screw 60 is tightened to thus fix the angle for future use. Alternate embodiments are contemplated for moving the alignment apparatus with respect to the club, for instance a structure that slide between the heel and toe of the club so that the horizontal member 42 is offset with respect to the ball mark 30, but maintains the mark 30 within the slot 44 of the horizontal member as viewed from the golfer's perspective.

Figure 5A:
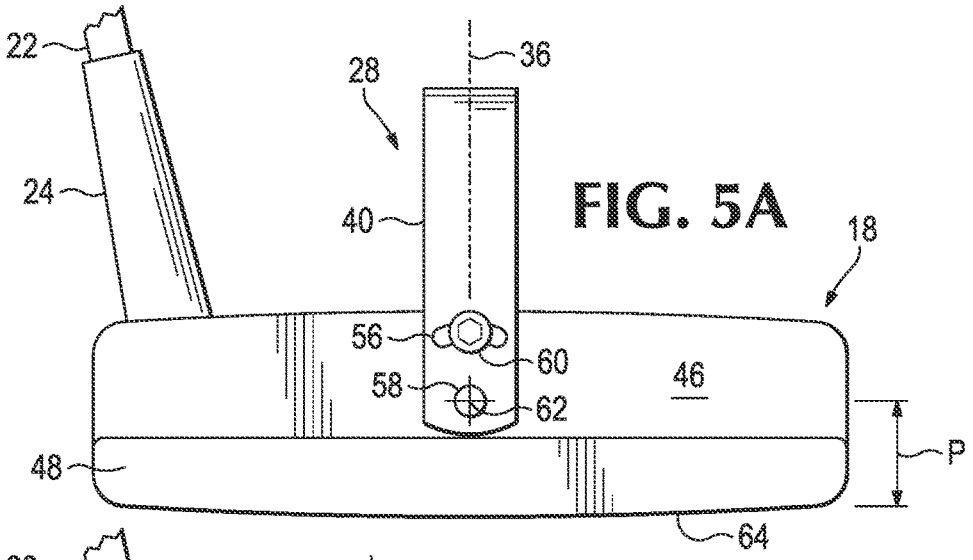
FIGS. 5A and 5B are rear elevation views of the putter head and alignment bar showing the alignment bar in an upright setting and in an inclined setting, respectively.
Figure 5B:
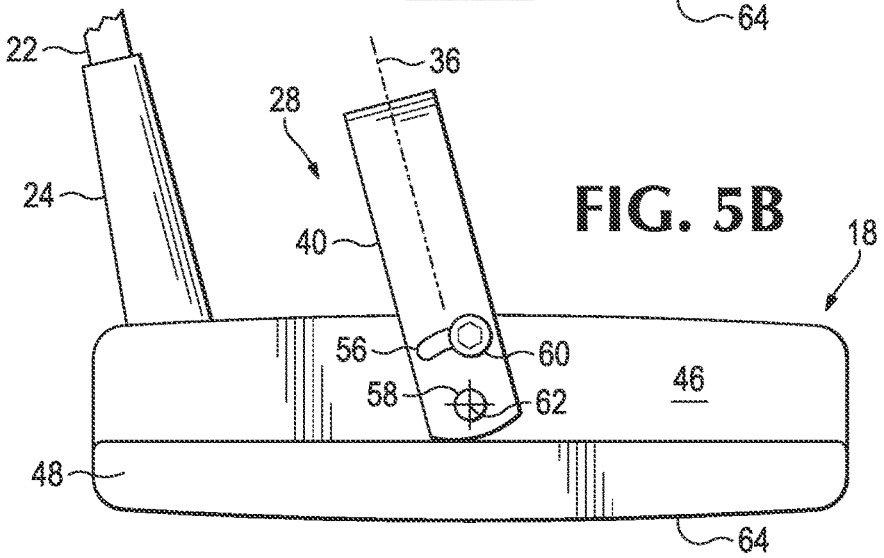

FIGS. 5A and 5B illustrate how the alignment apparatus 28 may be tilted in a plane substantially parallel with the putting face 20 of the putter and around pivot axis 62. FIG. 5A shows the alignment apparatus 28 in a fully upright position to accommodate a golfer 10 when positioned with his head directly above the golf ball as shown in FIG. 1. Screw 60 is shown centered within the arcuate slot 56. Alternatively, FIG. 5B shows the alignment apparatus 28 in a fully reclined position as limited by the stop on one side of the arcuate slot 56 where screw 60 is to one side of the slot and site line 36 is angled with the hosel 24 to accommodate a golfer 10 whose head is positioned closer to the golfers body and below the ball. The arcuate shape of slot 56 allows an infinite variation and selection of angles to accommodate golfers with a variety of stances, and adjustably fixes the pivot angle of the alignment apparatus to one of a plurality of selectable angles. When so moved, the alignment apparatus 28 is tilted to a desired angle so that the eyes of the user when addressing the ball center the mark 30 on the ball 14 within the linear slot 44.

It is not necessary that the pivot attachment point 58 be lower on the alignment apparatus 28 vertical portion 40 than the moving attachment point 56. The attachment points 56, 58 can be switched and still have a similar effect. Furthermore, it is possible that a single pivot attachment point can be used without the second point, although this runs a further risk of loosening over time and changing the preset tilt angle of the alignment apparatus.

Figure 6:
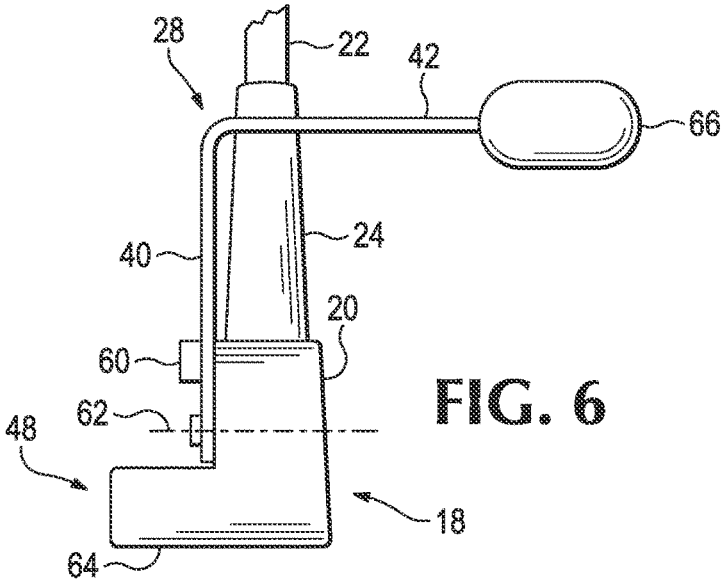
FIG. 6 is a side elevation view of an alternate embodiment of the putter head with alignment bar where a weight is attached to the front end of the alignment bar to move the center of gravity of the club toward the striking face of the putter.
Figure 9:
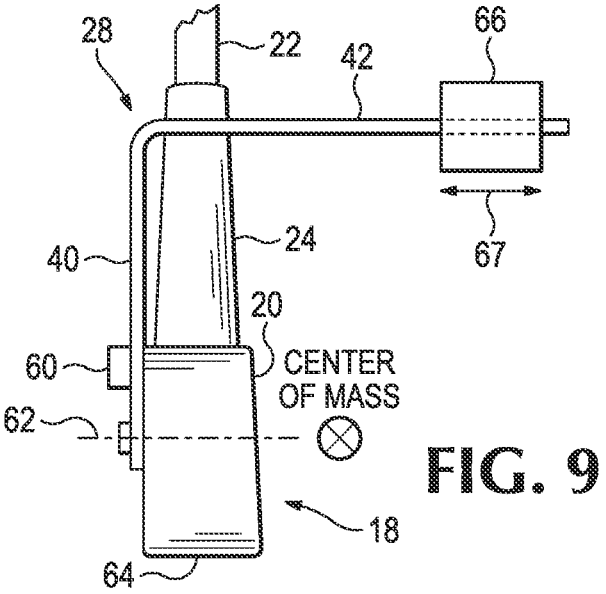
FIG. 9 is a side elevation view of yet another alternate embodiment of the putter head with alignment bar with adjustable weight portion.

FIG. 6 illustrates an alternate embodiment of the invention where the alignment apparatus 28 includes a weighted portion 66 affixed to a terminal end of the horizontal member 42 forwardly of the golf ball 14. The weight 66 is configured in mass and position so that it acts to move a center of mass of the club head 18 forwardly toward the striking face 20 of the golf club 16. In a most preferred embodiment, the weight is configured in mass and position to move the center of mass of the club head 18 in substantial alignment with or in front of the striking face 20 of the golf club 16. This weight changes the balance of a typical putter, where the center of mass is typically behind the striking face 20, to a position closer to the front where greater control over the swing may be realized. In one embodiment, such as shown in FIG. 9, the weight 66 may be moved 67 linearly along an axis of the horizontal member 42 and substantially perpendicular to a plane of the striking face 20 so that the center of mass may be adjusted forwardly of the striking face according to the golfer's preference. In another embodiment, the weight 66 may be detached and another weight of different size, density, and/or weight may be selected to impart a desired location to the center of mass.

FIG. 7 illustrates the alignment apparatus in use with a golfer 100 who sets up differently than the golfer shown in FIG. 1. The golfer 100 in FIG. 7 has his eyes closer to his body, thus resulting in a viewing angle to the golf ball 14 that varies at an inclined angle $\alpha$ from vertical. The alignment apparatus 28 can then be tilted toward the golfer to accommodate such a stance and so that the ball mark 30 aligns with or within the alignment structure or slot 44, respectively.

Figure 8:
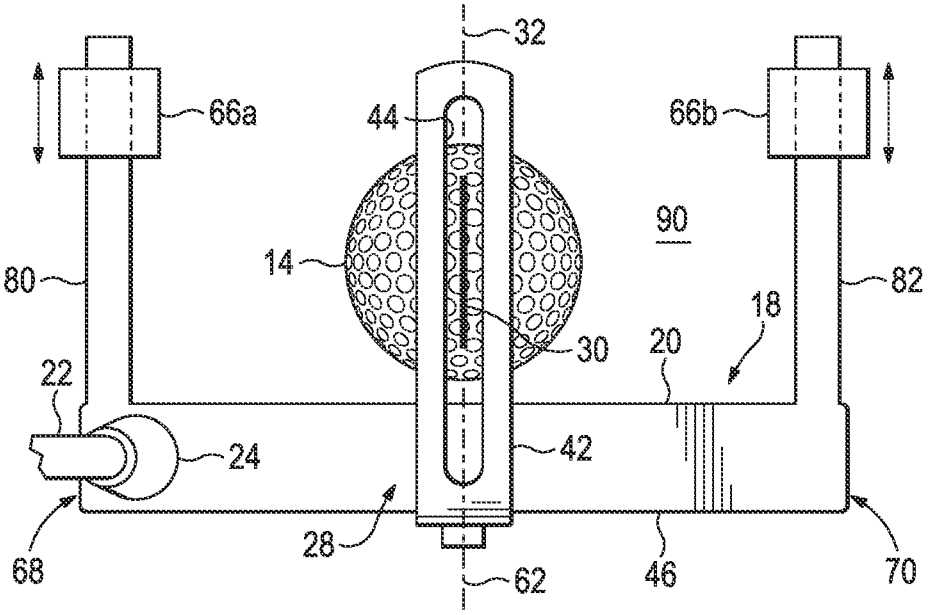
FIG. 8 is a top plan view of yet another embodiment of a putter with alignment guide bar with weighted portions extending forwardly at the heel and toe of the putter.

FIG. 8 illustrates an alternate embodiment of the putter whereby a first weighted structure 80 extends forwardly of the putter striking face 20 at a heel 68 of the putter and a second weighted structure 82 extends forwardly of the putter striking face at a toe 70 of the putter. The putter further includes weights 66*a*, 66*b* formed on terminal ends of the first and second weighted structures 80, 82, wherein said weights 66*a*, 66*b* are formed of a denser material than the putter head so that a center of gravity of the putter head moves in front of the striking face 20 of the putter. The weights 66*a*, 66*b* may be adjustable along the length of their respective weighted structures 80, 82 to adjust the position of the putter head center of mass to accommodate the preference of the golfer. Weighted structures 80, 82 may extend at a right angle to the striking face 20 of the putter or outwardly so that the golf ball 14 is aligned within the volume 90 between the structures 80, 82.

The putter head and various weights and structures can be formed of different materials to affect the putter head's center of mass. In one embodiment the putter head/blade 18 can be formed of a light carbon material whereas the weights formed on the tips of the weighted structures are formed of a heavier metal such as lead. The center of mass of the putter then moves forwardly of the striking face of the putter and within the alignment slot so that it centers along the ball mark. It is noted that to further facilitate movement of the center of mass forward, that the weighted lower lip 48 is removed from the putter head 18.

Alternate versions of the alignment means are contemplated. The alignment slot 44 on the horizontal member need not be a single aperture but can be several apertures formed along the axis of the horizontal member 42 of the alignment bar 28. The alignment means need not even include a slot or aperture, but rather include a straight edge that aligns with the mark on the ball and is pivotable in an axis parallel to the putting surface. Finally, it would be possible to include multiple alignment apparatus, such as on each side of the putter striking face 20—e.g. one on the toe, on in the middle, and one on the heel of the putter—which each align with different elements of the ball, the ball mark, or club face.

Figure 10:
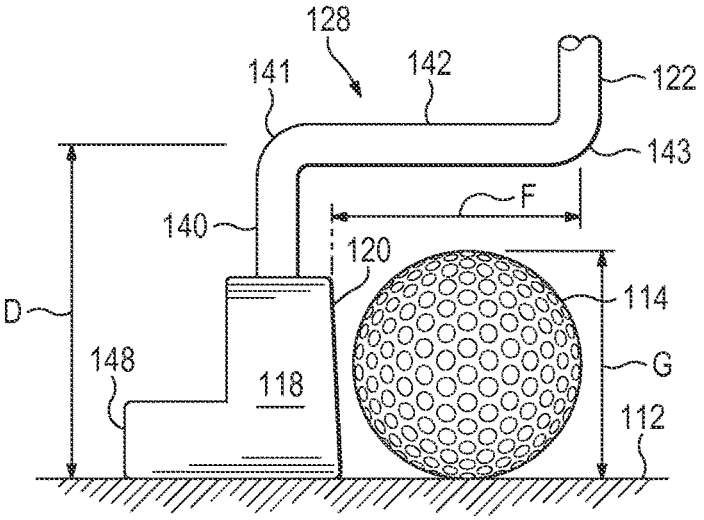
FIG. 10 is a side elevation of still yet another alternate embodiment of the invention of the shaft coupled directly to the alignment bar.
Figure 11:
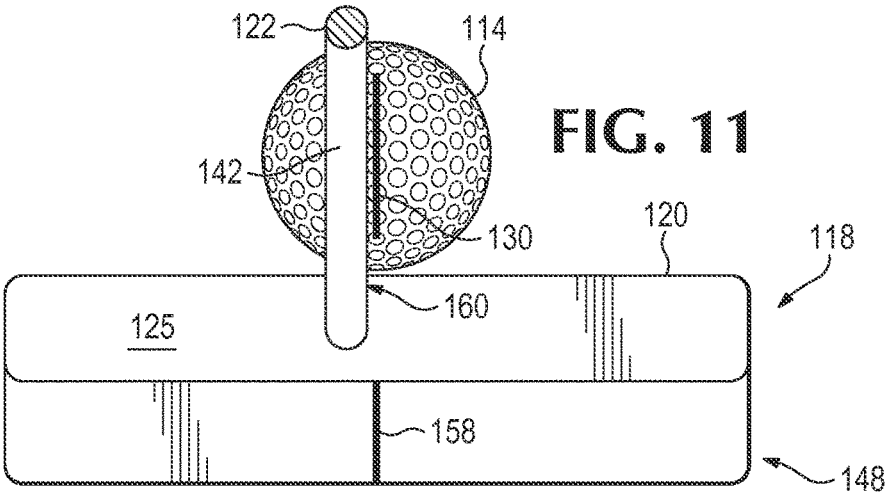
FIG. 11 is a top plan view of the embodiment shown in FIG. 10 showing the edge of the alignment bar aligned with a mark on the golf ball.
Figure 12:
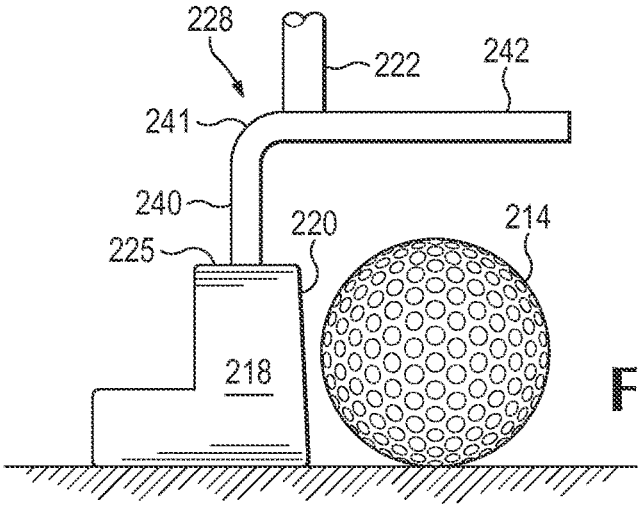
FIG. 12 is a side elevation of an alternate embodiment of FIG. 10 with the alignment bar coupled to a proximal portion of the alignment bar.

FIGS. 10-12 illustrate two addition embodiments of the invention, e.g. (1) where the shaft is coupled directly to the rear portion of the alignment bar, which itself is coupled to the club head; or (2) where the shaft is coupled directly to the front portion of the alignment bar, or alternately the shaft is forward of the striking face of the club and bends rearwardly until it attaches to the club head with the bent portion substantially perpendicular to a striking plane of the putter.

FIGS. 10 and 11 show an alternate embodiment of the alignment bar 128 attached to a top surface 125 of club head 118. Club head 118 may or may not include a weighted lower lip 148. Alignment bar 128 is shaped to include a vertical section 140 raising the alignment bar to a height D measured from ground 112 above the top level of golf ball 114, and leading to a 90-degree bend 141 that extends a horizontal section 142 forwardly of club face 120 by a distance F. Distance F is preferably longer than a diameter G of the golf ball so that a distal section of alignment bar 128 ends forwardly of the golf ball. However, F can be shorter as well so that at least a substantial portion of the aligning edge 160 can be aligned with the ball mark 130. A second upward bend 143 extends the alignment bar 128 to a second vertical section 122 that can also be, or be attached directly to, the club shaft. Whereas the distance G is a generally accepted standard of 4.267 cm, distance D is preferably approximately the height of the club head plus 3 cm and distance F approximately 5 cm.

In total, the shaft is coupled directly to the front portion of the alignment bar, or alternately the shaft is forward of the striking face of the club and bends rearwardly until it attaches to the club head with the bent portion substantially perpendicular to a striking plane of the putter In use, a golfer lines up the horizontal section 142 of the alignment bar with a linear mark 130 on the ball. The ball mark 130 can also be aligned with a club alignment mark 158 formed on the club head 118 transverse to the striking surface 120 of the club—here formed on a top surface of the weighted lower lip 148. If the horizontal section 142 includes a slot (not shown) such as those embodiments described above, then the ball alignment mark 130 can be aligned within the linear slot. In this configuration, the base of the alignment bar 128, e.g. where it attaches to the club head, is generally in alignment with the club alignment mark 158. Without a slot, however, the alignment bar 128 instead attaches rearwardly of the alignment mark 158 closer to the heel of the club. A player's head position (see e.g. FIG. 7) can affect the alignment of the aligning structure with the alignment marks 130, 158, and thus the attachment point of the horizontal member—which can be slightly reclined slightly back toward the heel of the club and not necessarily perpendicular to the top surface 125 of the club head 118—can be adjusted to fit the stance of the particular golfer. The alignment bar can have an aligning structure, such as an aligning edge 160 on an edge facing the golf ball. Proper alignment can occur by coaxially aligning this edge 160 between the ball alignment mark 130 and the club alignment mark 158.

FIG. 12 is a side elevation of an alternate embodiment of FIG. 10 with the club shaft 222 coupled to a proximal portion of the alignment bar adjacent first bend 241. Whereas the alignment bar 128 shown in FIGS. 10 and 11 has a circular cross-section similar to the shaft 122 of the golf club, the alignment bar 228 is more bar shaped with a flattened top and bottom. The configuration is nearly the same as in the previous embodiment, with a first vertical section 240 attaching to a top surface 225 of club head 218 raising the level of the alignment bar above the top level of the golf ball 214. A first 90-degree bend 241 at a proximal portion of the alignment bar 228 couples the vertical section 240 with a horizontal section 242 that extends to a distal edge forwardly of the golf ball 214. Shaft 222 is coupled in substantial alignment with the club striking face 220 adjacent the proximal portion of the horizontal section 242, e.g. near bend 241. The shaft then extends upwards to the grip (not shown) as in a normal club. As with previous embodiments, the horizontal section can include a slot or simply have an alignment edge for alignment with a mark made on the ball.

Having described and illustrated the principles of the invention in a preferred embodiment thereof, it should be apparent that the invention can be modified in arrangement and detail without departing from such principles. I claim all modifications and variation coming within the spirit and scope of the following claims.

I claim:

1. A putter with alignment apparatus comprising:

a putter head having a forwardly directed striking face, an opposing putter back wall, and a bottom sole;

an elongate shaft; and a putter alignment apparatus comprising:

a vertical member attached to the putter back wall and extending upward a sufficient distance above the bottom sole of the putter to be higher than a golf ball to be struck by the putter;

a horizontal member attached to the vertical member at an upper end and extending forwardly of the striking face, the elongate shaft coupling to the horizontal member; and an alignment structure formed in the horizontal member for aligning with a mark placed on the golf ball to be struck by the putter, wherein alignment of the mark with the alignment structure from a point of view of a user of the putter facilitates alignment of the putter head with the golf ball so that the struck golf ball travels in an intended direction, wherein the shaft is coupled directly to a rearward portion of the alignment structure and located in substantial alignment with the striking face.

2. The putter of claim 1, further including a first bend coupling the vertical member to the horizontal member.

3. The putter of claim 2, wherein the first bend is 90-degrees.

4. The putter of claim 1, wherein the alignment structure includes an elongate slot centrally formed along a long axis of the horizontal member of the alignment bar and configured such that a mark placed on a golf ball may be aligned within the slot to facilitate alignment of the putter with the golf ball in a direction of intended movement.

5. The putter of claim 1, wherein the alignment structure has a different cross-section than the elongate shaft.

6. The putter of claim 5, wherein the alignment structure includes a flattened top and bottom surface.

7. A putter comprising:

a club head having a forwardly directed striking face, a bottom sole, a toe portion, a heel portion, and a central portion;

an alignment mark located in the central portion of the club head behind the striking face;

an alignment bar coupled to the club head and extending over and forwardly of the striking face and terminating at a distal end, and further including a vertical section coupled to the club head, a horizontal section extending to the distal end, and a first bend coupling the vertical section to the horizontal section; and a putter shaft coupled directly to the alignment bar rearward of the distal end and extending upward to terminate in a putter grip, wherein the putter shaft is coupled adjacent the first bend in substantial alignment with the club striking face.

8. The putter of claim 7, wherein the alignment bar has a different cross-section than the putter shaft.

9. The putter of claim 8, wherein the alignment bar includes a flattened top and bottom surface.

10. The putter of claim 7, wherein the first bend is 90-degrees.

11. The putter of claim 7, wherein the alignment bar includes an outer edge fixed in substantially perpendicular relationship to the striking face of the club from a point of view of a user and configured to enable the user to align the outer edge with a mark placed on a golf ball.

12. The putter of claim 7, wherein the alignment bar includes an elongate slot centrally formed along a long axis of the horizontal section of the alignment bar and configured such that a mark placed on a golf ball may be aligned within the slot to facilitate alignment of the putter with the golf ball in a direction of intended movement.

13. A putter comprising:

a club head having a forwardly directed striking face, a bottom sole, a toe portion, a heel portion, and a central portion;

an alignment mark located in the central portion of the club head behind the striking face;

an alignment bar coupled to the club head and extending over and forwardly of the striking face and terminating at a distal end, and further including a vertical section coupled to the club head, a horizontal section extending to the distal end, and a first bend coupling the vertical section to the horizontal section; and a putter shaft coupled directly to the alignment bar rearward of the distal end and extending upward to terminate in a putter grip, wherein the alignment bar includes an elongate slot centrally formed along a long axis of the horizontal section of the alignment bar and configured such that a mark placed on a golf ball may be aligned within the slot to facilitate alignment of the putter with the golf ball in a direction of intended movement.

14. The putter of claim 13, wherein the alignment bar has a different cross-section than the putter shaft.

15. The putter of claim 14, wherein the alignment bar includes a flattened top and bottom surface.

16. The putter of claim 13, wherein the first bend is 90-degrees.

* * * * *